US009718178B2

(12) United States Patent
Marusich

(10) Patent No.: US 9,718,178 B2
(45) Date of Patent: Aug. 1, 2017

(54) STAPLE REMOVER

(71) Applicant: Joseph Michael Marusich, Gilbert, AZ (US)

(72) Inventor: Joseph Michael Marusich, Gilbert, AZ (US)

( * ) Notice: Subject to any disclaimer, the term of this patent is extended or adjusted under 35 U.S.C. 154(b) by 643 days.

(21) Appl. No.: 14/252,213

(22) Filed: Apr. 14, 2014

(65) Prior Publication Data

US 2014/0217338 A1 Aug. 7, 2014

Related U.S. Application Data

(63) Continuation of application No. 13/153,916, filed on Jun. 6, 2011, now Pat. No. 8,733,607.

(60) Provisional application No. 61/352,052, filed on Jun. 7, 2010.

(51) Int. Cl.

| | |
|---|---|
| ***B25C 11/00*** | (2006.01) |
| ***B25C 5/13*** | (2006.01) |
| ***B25C 5/15*** | (2006.01) |

(52) U.S. Cl.

CPC ..... *B25C 11/00* (2013.01); *B25C 5/13* (2013.01); *B25C 5/15* (2013.01)

(58) Field of Classification Search

CPC .... A43D 61/00; B25C 11/00; Y10T 29/49821
See application file for complete search history.

(56) References Cited

U.S. PATENT DOCUMENTS

| | | | | | |
|---|---|---|---|---|---|
| 448,023 | A | | 3/1891 | Gordon | |
| 1,268,021 | A | * | 5/1918 | Lancaster | A43D 61/00 12/16 |
| 2,183,695 | A | | 12/1939 | Robinson | |
| 2,333,700 | A | * | 11/1943 | Campbell | A43D 61/00 12/16 |
| 2,522,769 | A | | 9/1950 | Anderson | |
| 2,727,259 | A | | 12/1955 | Steimen | |
| 2,735,649 | A | * | 2/1956 | Swallert | B25C 11/02 254/18 |
| 3,126,195 | A | * | 3/1964 | Taylor | B25C 11/00 254/28 |
| 3,643,918 | A | * | 2/1972 | Ellis | B25C 11/02 254/19 |
| 4,245,817 | A | * | 1/1981 | Peoples | B25C 11/02 254/28 |

(Continued)

*Primary Examiner* — Andrew M Tecco
(74) *Attorney, Agent, or Firm* — Whitley Legal Group, PC; AnnMarie W. Whitley

(57) ABSTRACT

An automatic staple remover in a gun-shaped housing comprises a trigger that engages a series of levers and one or more springs that ultimately engage a rotating tumbler. Alternatively, the trigger engages an electric motor and gears, or a pneumatic motor and lever arrangement, or a combination of levers and motors to engage the rotating tumbler. Around the perimeter of the tumbler are one or more teeth capable of sliding under a staple. Positioned below the tumbler a removable receptacle catches removed staples. Additionally, the automatic staple remover can include stapler components side-by-side in the same housing that can be engaged by a common trigger. Stapler components comprise a series of levers and springs, a blade assembly, and a plurality of staples in a sleeve. Alternatively, stapler components can include pneumatic motor components or electric motor components.

3 Claims, 9 Drawing Sheets

(56) References Cited

U.S. PATENT DOCUMENTS

| | | | | |
|---|---|---|---|---|
| 4,455,736 | A | 6/1984 | Owen | |
| 5,524,866 | A | 6/1996 | Taylor | |
| 5,605,320 | A | 2/1997 | Crawford | |
| 5,996,969 | A | 12/1999 | Johnston et al. | |
| 6,260,825 | B1 | 7/2001 | Willis | |
| 6,772,995 | B2 | 8/2004 | Wen et al. | |
| 6,877,401 | B1 * | 4/2005 | Giltner | B25B 13/48 81/52 |
| 7,140,087 | B1 * | 11/2006 | Giltner | B25B 13/44 254/18 |
| 2004/0262586 | A1 | 12/2004 | Moscone | |
| 2007/0040155 | A1 | 2/2007 | Pan | |
| 2009/0267034 | A1 | 10/2009 | Marks et al. | |

* cited by examiner

STAPLE REMOVER

CROSS-REFERENCE TO RELATED APPLICATIONS

This application claims the benefit of co-pending U.S. application Ser. No. 13/153,916 filed Jun. 6, 2011, which claims the benefit of U.S. Provisional Application 61/352,052 filed Jun. 7, 2010.

FIELD OF INVENTION

This invention relates to a device for removing staples. More particularly, this device relates to an automatic staple remover. Additionally, this device relates to a combination staple remover gun and staple gun.

BACKGROUND

Anyone who uses staples in the course of their business often has reason to remove staples as well. This is especially true for people working in certain professions. Teachers, for example, often staple displays or papers around their classrooms. When the teachers need to change the displays or remove the papers, the staples must be removed. Because the staples are spread over vertical surfaces and sometimes high overhead on the wall or ceiling, it is particularly difficult to remove them. Similarly, people in construction may use staples to secure items. Numerous staples may be used around the perimeter of a room, which eventually will need to be removed if remodeling. Removing a large quantity of staples is often tedious using conventional staple-removing technology.

Typical methods of removing staples include using a simple flat push-type remover that is slid under the staple and lifted or a claw-type remover that is slid under the staple to grab it. Both of these methods require a person to carefully position the staple remover and exert a substantial amount of force. Additionally, the user must take care to collect the removed staples and dispose of them individually. While these may be easy for the occasional staple removal from a document, these conventional removers become tedious when removing several staples or when removing staples from a vertical surface such as a bulletin board or wall.

Automated methods of removing staples have been developed, but none are particularly suited for removing staples from large immovable vertical surfaces such as walls or for removing substantial quantities of staples in a short amount of time. For example, automated versions of the claw-type remover still require the user to carefully position the claws around each staple. Additionally, each removed staple must still be disposed of individually. It would be desirable to have an automated staple remover that requires less effort to operate, is simple to position near a staple, and collects staples in a receptacle for later disposal. It would also be desirable to combine a staple remover and stapler in one unit.

SUMMARY OF THE INVENTION

The present invention is a staple remover for removing staples from stapled surfaces or items such as papers, bulletin boards, walls, and floors. The staple remover has a housing generally shaped like a gun. A trigger cooperates with the handle of the gun. When squeezed, the trigger engages a series of levers and one or more springs that ultimately engage a rotating tumbler. The tumbler can make a full rotation each time the trigger is squeezed or the tumbler can rotate a set amount every time the trigger is squeezed through a ratcheting mechanism. Around the perimeter of the tumbler are one or more teeth capable of sliding under a staple.

To remove a staple, the tumbler and teeth are aimed at the staple. A user depresses the trigger, which in turn activates the series of levers. The levers rotate the tumbler so that one of the teeth slides under the targeted staple and lifts it from the stapled surface. As the tumbler continues to rotate, the staple slides off the tumbler and is deposited in a removable receptacle for collecting the removed staples.

As an alternative to the tumbler, a belt or chain encircling two or more wheels can be used. The belt or chain would also include a series of teeth capable of sliding under a staple. As an alternative to the levers and springs, a series of gears, a combination of levers and gears, or gears and a drive belt could be used engage the tumbler when the trigger is squeezed. Additionally, the tumbler, belt, or chain can be driven by electric power so that when a trigger or button is pushed, a motor activates the tumbler, belt, or chain through a series of gears or levers and springs. The tumbler, belt, or chain can also be driven by pneumatic power so that when a trigger or button is pushed, compressed air causes a plunger and piston to activate the tumbler, belt, or chain through a series of gears or levers and springs.

The staple remover can also be combined with a stapler in a common housing. The staple remover and stapler are activated by a common trigger that includes a switch for selecting whether to operate the stapler or the staple remover.

DETAILED DESCRIPTION OF THE INVENTION

The present invention is a staple remover 10 for removing staples from stapled surfaces or items such as papers, bulletin boards, walls, and floors. Preferably, the staple remover 10 has a housing 11 generally shaped like a gun such as a handgun or pistol as shown in the Figures. Handguns and pistols are well known as having a barrel section 11*a* and a grip or handle section 11*b*.

Figure 1:
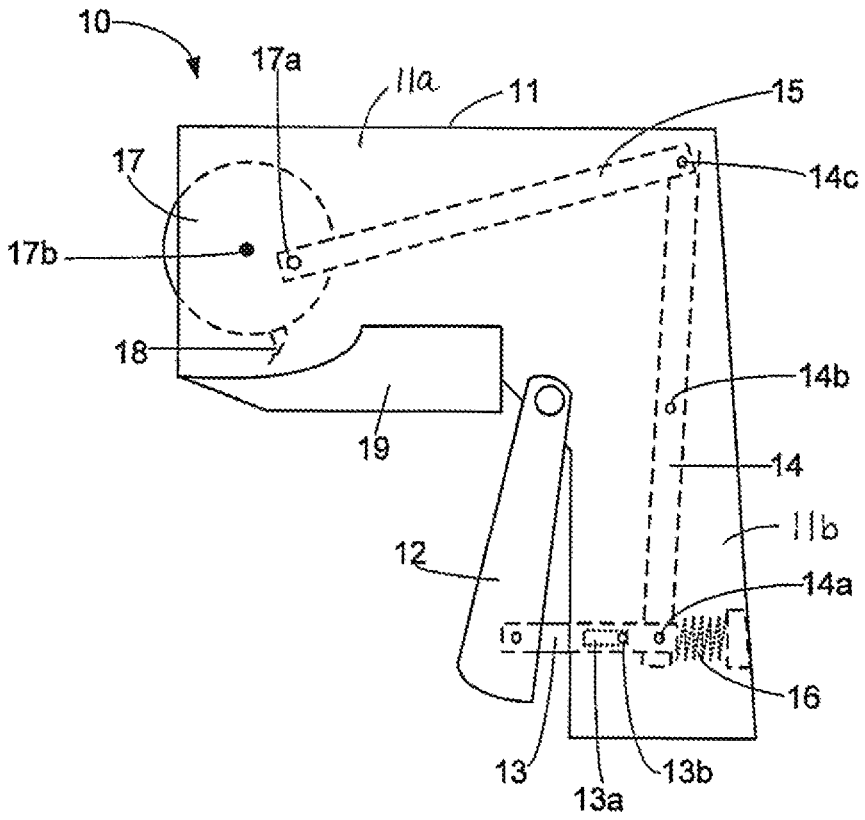
FIG. 1 is a side view of a first embodiment of the present invention where a tumbler is activated by levers and springs.

FIG. 1 illustrates a first embodiment of staple remover 10. A trigger 12 cooperates with the grip section or handle section 11*b* of the gun-shaped housing 11. When squeezed, the trigger 12 engages a series of levers 13, 14, and 15 and one or more springs 16 that ultimately engage a rotating tumbler 17. As shown, trigger 12 is pivotally attached to housing 11 with fastener 12*a* and is positioned so that when trigger 12 is squeezed it pushes lever 13 against spring 16. Spring 16 is positioned inside and secured to housing 11 and is biased against lever 13. Lever 13 additionally forms a slot 13*a* that is positioned to cooperate with a peg 13*b* that is secured within housing 11. Slot 13*a* and peg 13*b* allow only linear movement of lever 13. Lever 14 has a first end that is adjacent to lever 13, a second end that is adjacent lever 15, and a center point 14*b* about which lever 14 pivots. Center point 14*b* can be any a fastener secured within housing 11 that allows lever 14 to pivot. The first end of lever 14 is pivotally connected to lever 13 with a fastener 14*a*, and the second end is pivotally connected to lever 14 with a fastener 14*c*. As lever 13 moves, the first end of lever 14 is displaced and lever 14 pivots around center point 14*b*. The second end of lever 14 is consequently displaced in an opposite direction from the first end of lever 14. Because lever 14 is connected to lever 15, lever 15 is also displaced.

As shown in FIG. 1, lever 15 is pivotally connected at a fixed point to tumbler 17 with fastener 17*a*. Tumbler 17 is secured partially within housing 11 and rotates about a central axis 17*b*. Consequently, as lever 15 is displaced, tumbler 17 rotates. Preferably, tumbler 17 makes at least one half of a full rotation when trigger 12 is squeezed and then rotates another half of a full rotation when trigger 12 is released. Accordingly, tumbler 17 makes a full rotation each time trigger 12 is squeezed and released. Also preferably, as shown, tumbler 17 is positioned in housing 11 so that it partially extends out of housing 11 at one end and can be positioned by the user adjacent a staple that needs to be removed.

Around the perimeter of tumbler 17 are one or more teeth 18 capable of sliding under a staple. Teeth 18 are preferably rigid and fixedly connected to tumbler 17. Alternatively, teeth 18 are integral with tumbler 17. As tumbler 17 and teeth 18 rotate, a tooth 18 slides under a staple and then pulls the staple out of the stapled surface. As tumbler 17 rotates, tooth 18 then carries the staple into the housing. Oriented below the tumbler and removably attached to housing 11 is a receptacle 19 for collecting removed staples. As tumbler 17 rotates further, the staples fall off teeth 18 and into receptacle 19.

Figure 2:
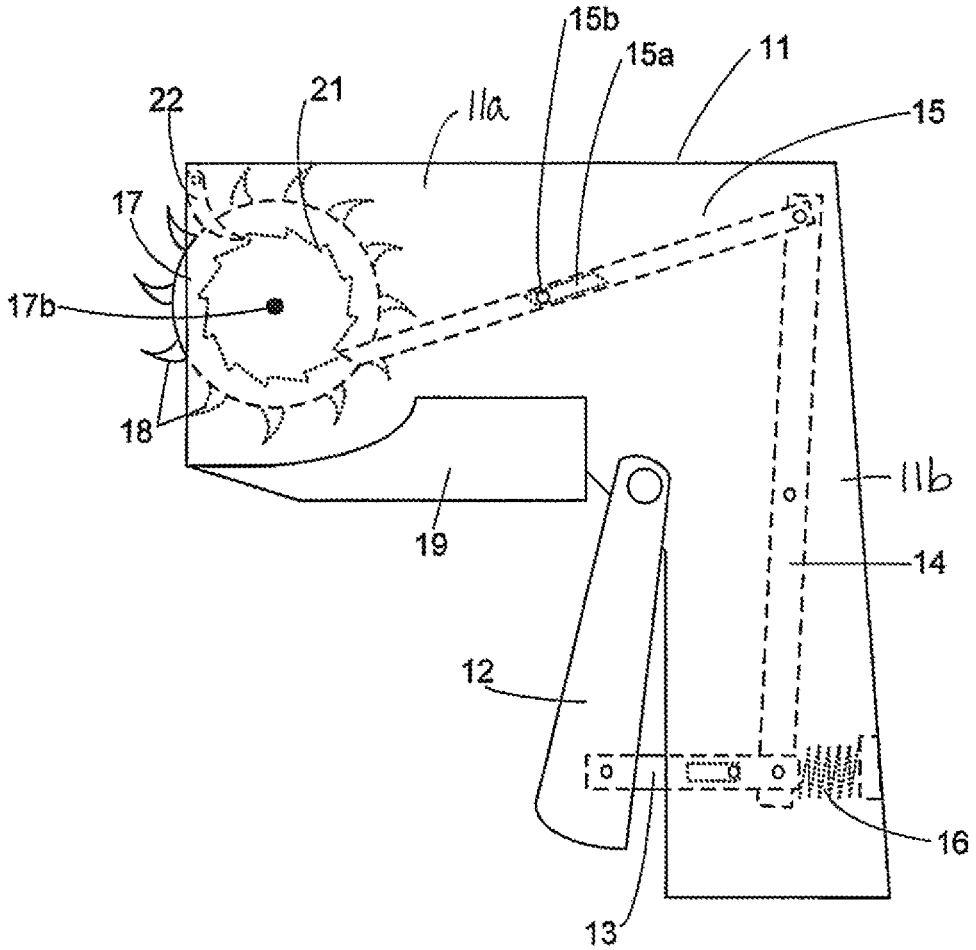
FIG. 2 is a side view of a second embodiment of the present invention where a ratcheted tumbler is activated by levers and springs.

FIG. 2 illustrates a second embodiment of staple remover 10. The second embodiment includes a ratchet mechanism for tumbler 17. While only one embodiment of a ratchet mechanism is illustrated, any other type of known ratchet mechanism can be substituted. As shown in FIG. 2 and similar to the first embodiment shown in FIG. 1, trigger 12 cooperates with the handle of the gun-shaped housing 11. When squeezed, the trigger 12 engages a series of levers 13, 14 and 15 and one or more springs 16 that ultimately engage the rotating tumbler 17. Trigger 12 and levers 13 and 14 are described above with respect to FIG. 1.

For the second embodiment of the staple remover shown in FIG. 2, lever 15 is pivotally connected to lever 14 with a fastener 14*c*. Lever 15 also defines a slot 15*a* that is positioned to cooperate with a peg 15*b* as shown in FIG. 2. Peg 15*b* is fixedly secured within housing 11, and slot 15*a* and peg 15*b* keep lever 15 substantially aligned to permit linear displacement only. Lever 15 additionally engages a toothed wheel 21 that is connected to tumbler 17. Toothed wheel 21 preferably rotates about and shares central axis 17*b* with tumbler 17. Toothed wheel 21 is preferably connected to tumbler 17 such that when toothed wheel 21 turns, tumbler 17 turns. A pawl 22 prevents toothed wheel 21 and consequently tumbler 17 from turning counter-clockwise. When lever 14 is displaced, lever 15 is also displaced causing toothed wheel 21 to rotate in a clockwise direction. Preferably, tumbler 17 rotates incrementally each time the trigger is squeezed. Tumbler 17 is positioned in housing 11 so that it partially extends out of housing 11 at one end and can be positioned by the user adjacent a staple that needs to be removed.

As with the first embodiment of the staple remover, around the perimeter of the tumbler are one or more rigid teeth 18 fixedly attached to the tumbler and capable of sliding under a staple. As tumbler 17 and teeth 18 rotate, they slide under the staple and then remove it from the stapled surface. Oriented below the tumbler and removably attached to housing 11 is a receptacle 19 for collecting removed staples. As tumbler 17 rotates, the staples fall off teeth 18 and into receptacle 19.

Figure 3:
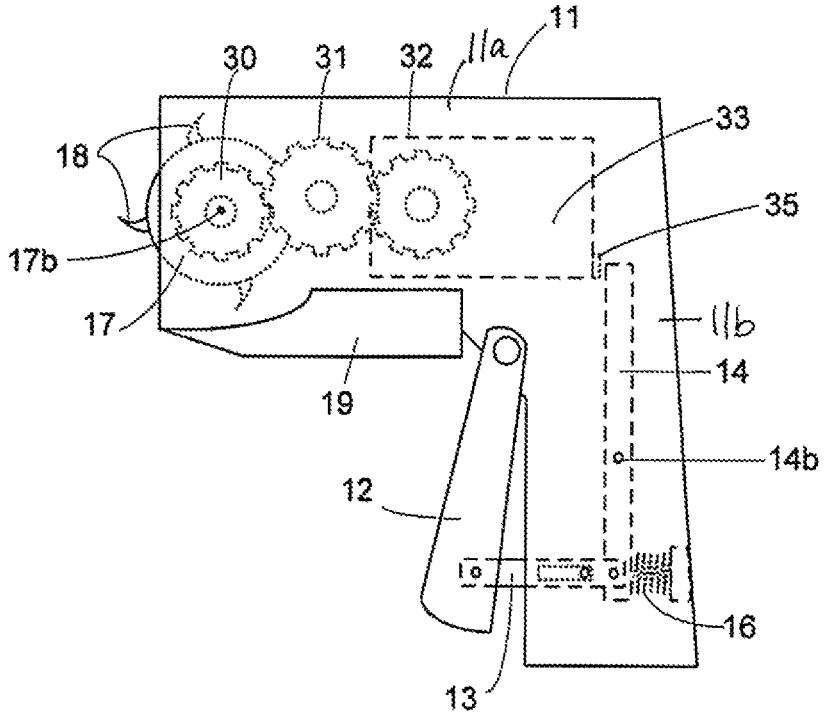
FIG. 3 is a side view of a third embodiment of the present invention where a tumbler is activated by a combination of levers, springs, an electric motor and gears.
Figure 4:
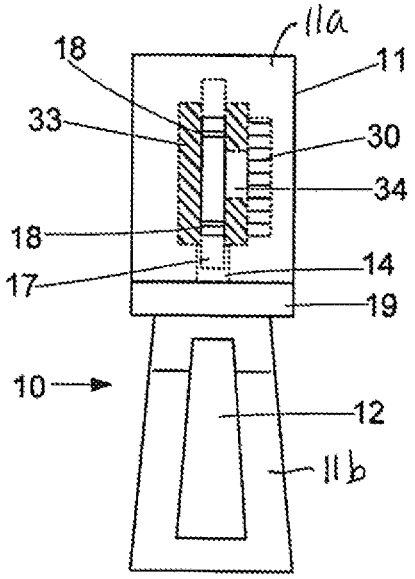
FIG. 4 is a front view of the third embodiment of the present invention where a tumbler is activated by a combination of levers, springs, an electric motor and gears.

FIGS. 3 and 4 illustrate a third embodiment of staple remover 10. The third embodiment incorporates levers, gears and a motor to activate tumbler 17. Similar to the first and second embodiments, trigger 12 cooperates with the handle of the gun-shaped housing 11. When squeezed, the trigger 12 engages levers 13 and 14 as described above.

For the third embodiment of the staple remover shown in FIGS. 3 and 4, the second end of lever 14 is positioned adjacent to a switch 35 that operates a motor 33. Motor 33 is removably secured within housing 11. When the second end of lever 14 is displaced, it activates switch 35. Switch 35 can either turn motor 33 on or off each time it is activated, or switch 35 can control motor 33 so that motor 33 only operates when lever 14 is in contact with switch 35. Motor 33 can be any motor suitable for handheld tools that produces rotary motion. Motor 33 can be powered with a battery or ordinary household electric current.

When motor 33 is activated, it causes one or more cooperative gears to turn. FIGS. 3 and 4 show three gears 32, 31, and 30, each rotatably secured within housing 11. Fewer or more gears can be used, however. As shown, gear 32 is driven by the motor and interacts with gear 31 so that when gear 32 rotates in a clockwise direction, gear 31 rotates counter-clockwise. Likewise, gear 31 interacts with gear 30 so that when gear 30 rotates in a counter-clockwise direction, gear 30 rotates clockwise. Gear 30 is preferably connected to tumbler 17 such that when gear 30 turns, tumbler 17 turns about central axis 17*b*. Gear 30 may be secured immediately adjacent to tumbler 17 or offset by a connector 34 as shown. Tumbler 17 is positioned in housing 11 so that it partially extends out of housing 11 at one end and can be positioned by the user adjacent a staple that needs to be removed.

As with the first two embodiments of the staple remover, around the perimeter of the tumbler are one or more rigid teeth 18 fixedly connected to tumbler 17 and capable of sliding under a staple. As tumbler 17 and teeth 18 rotate, they slide under the staple and then remove it from the stapled surface. Oriented below the tumbler and removably attached to housing 11 is a receptacle 19 for collecting removed staples. As tumbler 17 rotates, the staples fall off teeth 18 and into receptacle 19.

Figure 5:
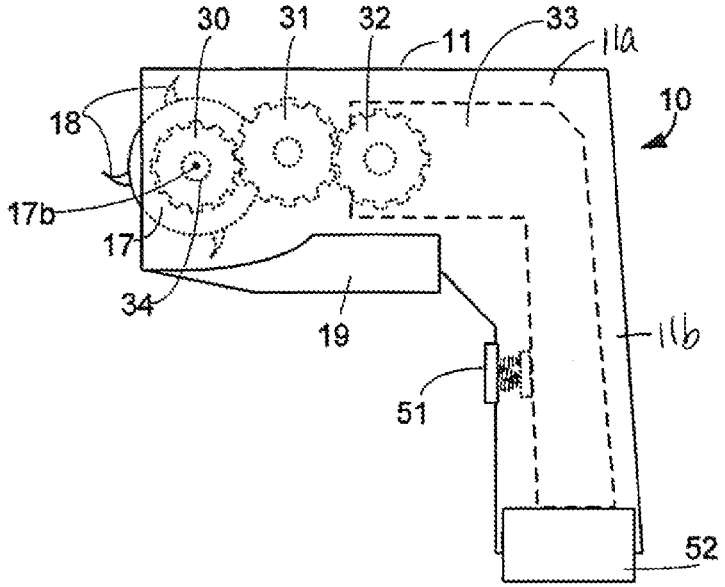
FIG. 5 is a side view of a fourth embodiment of the present invention where a tumbler is activated by an electric motor and gears.

FIG. 5 illustrates a fourth embodiment of staple remover 10. The fourth embodiment is similar to the third embodiment except that it eliminates the levers and trigger. A switch 51 is positioned on the handle of the gun. Switch 51 operates motor 33 and can either turn the motor on or off each time it is pressed, touched or contacted by the user, or it can control motor 33 so that motor 33 only operates when switch 51 is being pressed, touched or contacted by the user. Any type of switch can be used as long as it is easy for a user to operate with one or two fingers. Motor 33 and the gears and tumbler arrangement are positioned and operate as described above with respect to FIGS. 3 and 4. Motor 33 can be powered with a battery or ordinary household electric current. As shown in FIG. 5, motor 33 is powered by a removable battery attachment 52. The battery attachment can be a rechargeable battery.

As with the first three embodiments of the staple remover, around the perimeter of the tumbler are one or more rigid teeth 18 fixedly connected to tumbler 17 and capable of sliding under a staple. As tumbler 17 and teeth 18 rotate, they slide under the staple and then remove it from the stapled surface. Oriented below the tumbler and removably attached to housing 11 is a receptacle 19 for collecting removed staples. As tumbler 17 rotates, the staples fall off teeth 18 and into receptacle 19.

Figure 6:
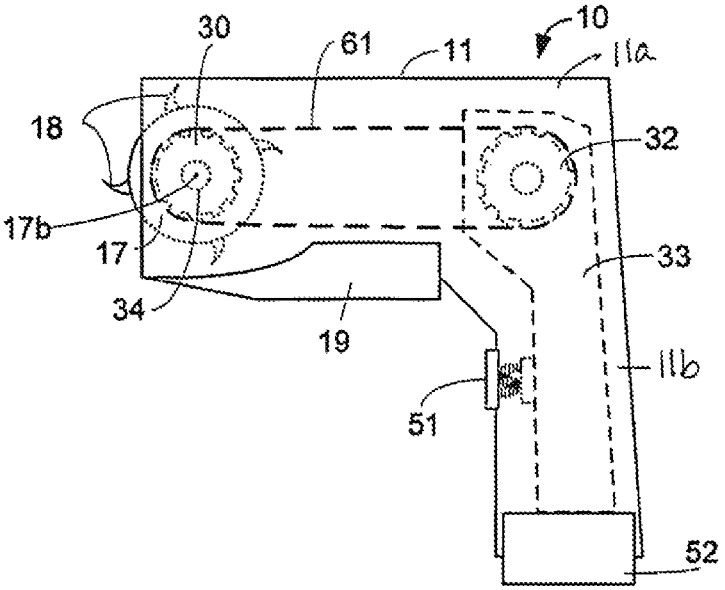
FIG. 6 is a side view of a fifth embodiment of the present invention where a tumbler is activated by an electric motor, gears, and a belt.

FIG. 6 illustrates a fifth embodiment of staple remover 10. The fifth embodiment is similar to the fourth embodiment except that it additionally includes a drive belt 61. Drive belt 61 encircles gear 32 and gear 30. When gear 32 rotates, belt 61 rotates, which causes gear 30 to also rotate. Both gears 30 and 32 and belt 61 preferably rotate in a clockwise direction. Gear 30 is fixedly attached to tumbler 17 such that it rotates about central axis 17*b* and causes tumbler 17 to rotate around central axis 17*b*. The remaining components of staple remover 10 are positioned and operate as described above with respect to FIG. 5.

Figure 7:
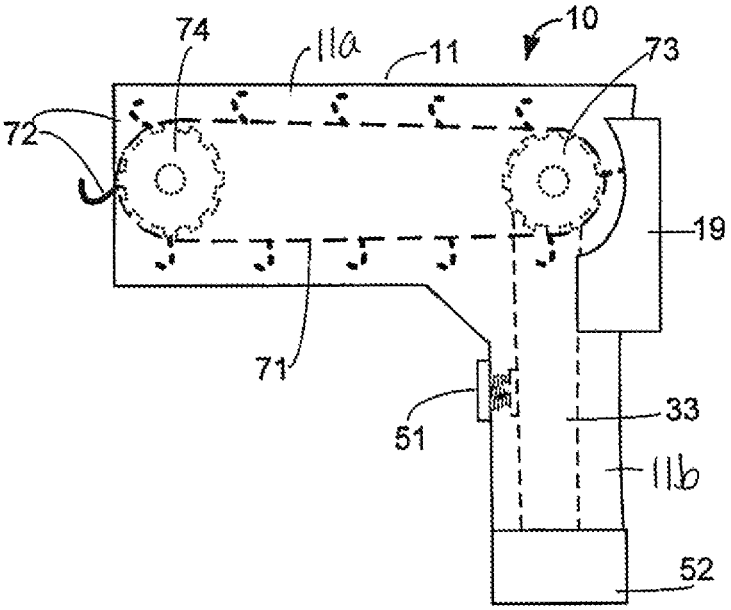
FIG. 7 is a side view of a sixth embodiment of the present invention where an electric motor and gears drive a toothed belt.

FIG. 7 illustrates a sixth embodiment of staple remover 10. The sixth embodiment replaces tumbler 17 with toothed belt 71. As with the fourth and fifth embodiments of the staple remover shown in FIGS. 5 and 6, a switch 51 is positioned on the handle of the gun. Switch 51 operates motor 33 and can either turn the motor on or off each time it is pressed, touched or contacted by the user, or it can control motor 33 so that motor 33 only operates when switch 51 is being pressed, touched or contacted by the user. Any type of switch can be used as long as it is easy for a user to operate with one or two fingers. Motor 33 can be powered with a battery or ordinary household electric current. As shown in FIG. 5, motor 33 is powered by a removable battery attachment 52. The battery attachment can be a rechargeable battery.

When motor 33 is activated, it causes a wheel or gear 73 to rotate. A toothed belt 71 is positioned at one end around gear 73. At the opposite end, the toothed belt 71 is positioned around an additional wheel or gear 74. Preferably, the motor causes gear 73 to rotate clockwise, which in turn causes the toothed belt 71 and gear 74 to rotate clockwise. Gear 74 and belt 71 are positioned in housing 11 so that belt 71 partially extends out of housing 11 at one end and can be positioned by the user adjacent a staple that needs to be removed.

Around the perimeter of the toothed belt 71 are one or more rigid teeth 72 fixedly connected to belt 71 and capable of sliding under a staple. As belt 71 and teeth 72 rotate, they slide under the staple and then remove it from the stapled surface. Oriented near and below the gear 73 and removably attached to housing 11 is a receptacle 19 for collecting removed staples. As belt 71 rotates, the staples fall off teeth 72 and into receptacle 19.

Figure 8:
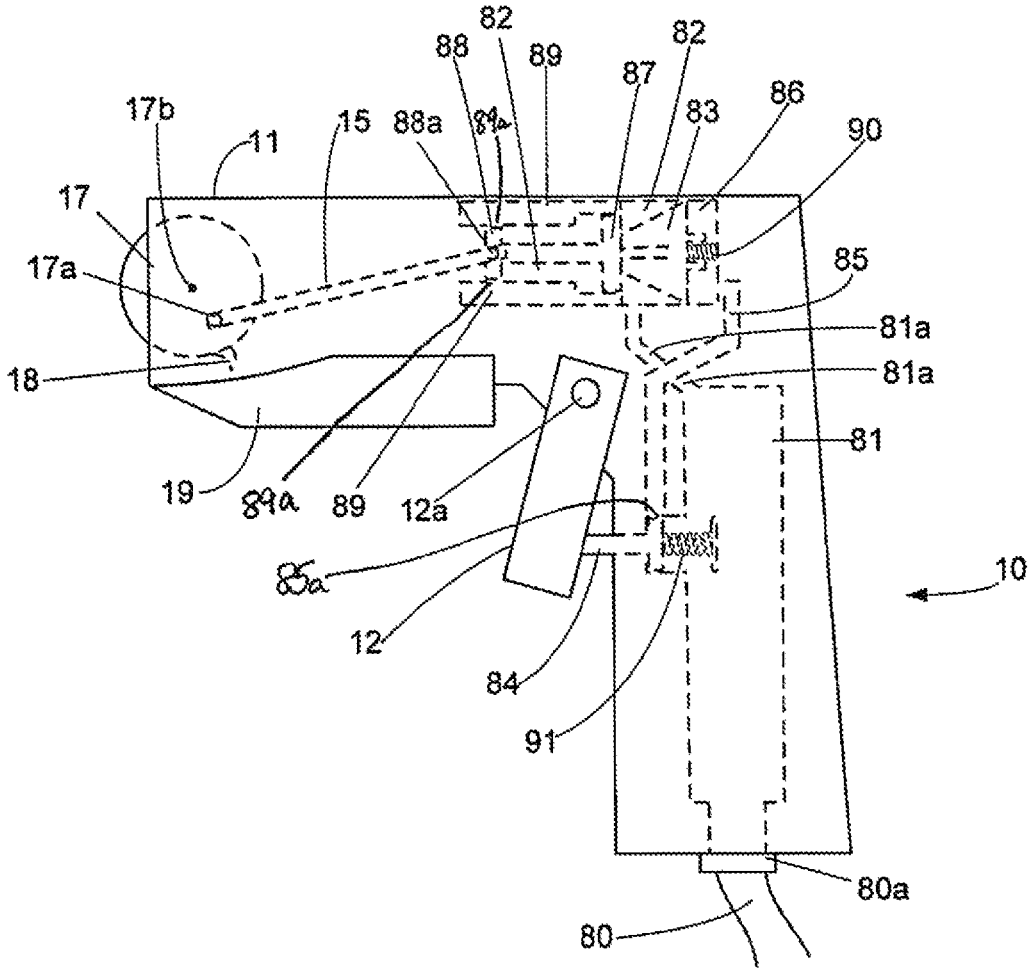
FIG. 8 is a side view of a seventh embodiment of the present invention where a tumbler is activated by a pneumatic motor arrangement and a lever.

FIG. 8 illustrates a seventh embodiment of staple remover 10. The seventh embodiment uses a pneumatic motor arrangement. Air from a source of compressed air such as an air compressor or compressed air cartridge is delivered to an air reservoir 81 through a hose 80 or inlet 80*a*. Air reservoir 81 is positioned in housing 11 and is in fluid communication with a lower air chamber 82 surrounding the lower side of a plunger 83, both of which are also positioned within housing 11. Trigger 12 cooperates with a sliding door 84 positioned at least partly within housing 11 so that door 84 is preferably linearly displaced when trigger 12 is engaged. When trigger 12 is not engaged, a spring 91 biases sliding door 84 and trigger 12 such that sliding door 84 covers an inlet 85*a* to air passageway 85. Spring 91 is fixedly secured at one end within housing 11. Air passageway 85 is preferably positioned within housing 11 and is in fluid communication an upper air chamber 86 surrounding the upper side of plunger 83 and positioned in housing 11. Plunger 83 cooperates with a piston 87 positioned within housing 11 and positioned adjacent to air return chamber 89. Piston 87 cooperates with a block 88 to which lever 15 is pivotally connected with a fastener 88*a*. Block 88 also preferably covers inlets 89*a* to return air chamber 89 when trigger 12 is not engaged. Block 88 is preferably integral with piston 87 as shown, or it can be a separate component that is fixedly attached to piston 87. A plunger spring 90 also cooperates with the upper surface of plunger 83 such that plunger 83 is biases against piston 87 and such that plunger spring 90 provides resistance to the compressed air in lower air chamber 82.

When trigger 12 is activated according to the seventh embodiment, compressed air is delivered from the air reservoir 81 to upper air chamber 86. The compressed air in upper air chamber 86 combined with the force from spring 89 displace plunger 83 enough to then displace piston 87. Piston 87 in turn displaces block 88, which displaces lever 15. As described above, because lever 15 is also pivotally connected to tumbler 17 with fastener 17*a*, as lever 15 is displaced, tumbler 17 rotates. Preferably, tumbler 17 makes a full rotation about central axis 17*b* each time the trigger 12 is squeezed. Tumbler 17 is positioned in housing 11 so that it partially extends out of housing 11 at one end and can be positioned by the user adjacent a staple that needs to be removed.

As with the other embodiments of the staple remover, around the perimeter of the tumbler are one or more rigid teeth 18 fixedly connected to tumbler 17 and capable of sliding under a staple. As tumbler 17 and teeth 18 rotate, they slide under the staple and then remove it from the stapled surface. Oriented below the tumbler and removably attached to housing 11 is a receptacle 19 for collecting removed staples. As tumbler 17 rotates, the staples fall off teeth 18 and into receptacle 19.

Figure 9:
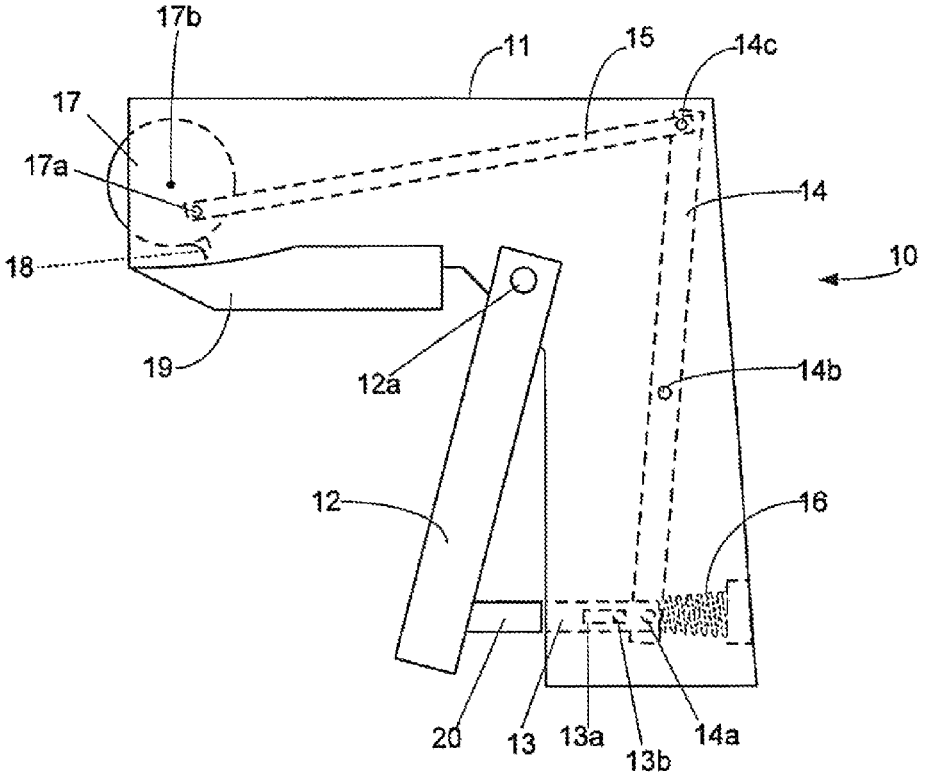
FIG. 9 is a first side view of an eighth embodiment of the present invention where staple remover components are side-by-side with stapler components.
Figure 10:
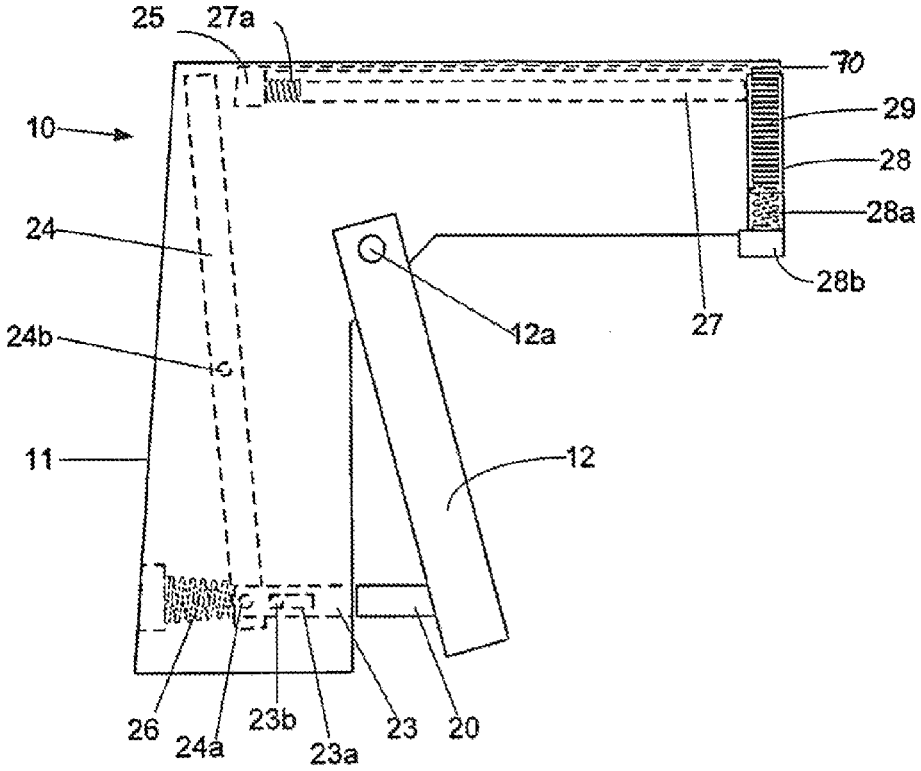
FIG. 10 is a second side view of an eighth embodiment of the present invention where staple remover components are side-by-side with stapler components.
Figure 11:
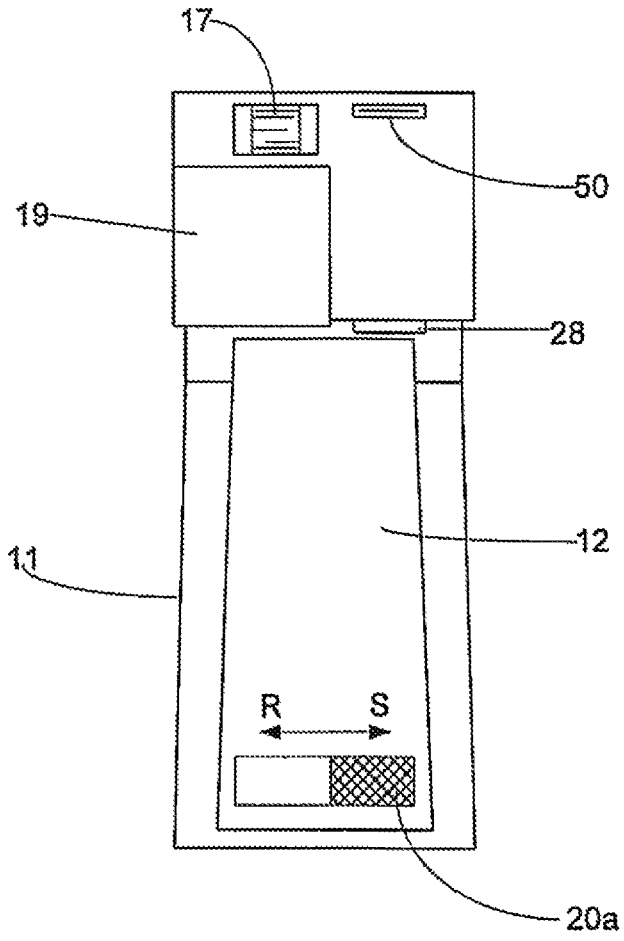
FIG. 11 is a front view of the eighth embodiment of the present invention where staple remover components are side-by-side with stapler components.

FIGS. 9-11 illustrate an eighth and preferred embodiment of staple remover 10. The eighth embodiment comprises stapler and staple remover components side by side in a common housing 11 and activated by a common trigger 12. The common trigger includes a switch 20 for selecting whether to operate the stapler or the staple remover. As shown in FIG. 9 in particular, the combined stapler and staple remover preferably use the staple remover components detailed with respect to the first embodiment of the staple remover as described above. Alternatively, any of the embodiments detailed herein can be used as the staple remover components for the combination device such as the pneumatic and electric motor embodiments.

FIGS. 10 and 11 illustrate the stapler components of the eighth embodiment. The stapler components can be any conventional stapler components as known in the prior art including electric and pneumatic components. The embodiment shown above includes a common trigger 12 and switch 20 that engage a lever 23. Lever 23 is positioned within housing 11 and translates along one direction due to a slot 23*a* formed by lever 23 and a peg 23*b* fixedly secured within housing 11. Lever 23 is biased against switch 20 by a spring 26, which is fixedly secured at one end within housing 11. Lever 23 is pivotally connected to a lever 24, which also pivots about a center point 24*b*. Center point 24*b* can be any fastener that secures lever 24 within housing 11 such that lever 24 can pivot about center point 24*b*. When one end of lever 24 is displaced it contacts a blade assembly comprising a blade 25, a spring 27*a*, and a support 27. Blade 25 is positioned within housing 11 as shown and is biased against lever 24 by spring 27*a* and support 27. Blade assembly 25 engages a staple 70, which is part of a plurality of staples 29 held in a sleeve 28. Sleeve 28 includes a spring 28*a* and locking assembly 28*b*. Blade assembly 25, when activated, pushes the staple through an opening 50 in housing 11. Sleeve 28 can be located within housing 11, partly within housing 11, or adjacent housing 11. Sleeve 28 can be removed to facilitate loading staples.

FIG. 11 shows how the front side of the combination device accommodates both staple remover and stapler components. The stapler and staple remover components generally are side by side in a common housing 11 and are activated by a common trigger 12. As shown in FIG. 11, tumbler 17 and receptacle 19 of the staple remover components are next to the opening 50 for staple 29 and sleeve 28 of the stapler components. Additionally, switch 20 can have a button 20*a* that slides switch 20 to engage either the stapler components (S) to the staple remover components (R) of the combination device. Other mechanisms for switching can be substituted, however, as is known in the art. Further, the components of the stapler can be replaced with other known stapler configurations, such as an electric stapler assembly or pneumatic stapler assembly. In particular, electric stapler components can be combined with one of the above staple remover embodiments comprising an electric motor. Similarly, pneumatic stapler components can be combined with the above embodiment of the staple remover comprising the pneumatic motor arrangement.

While there has been illustrated and described what is at present considered to be the preferred embodiment of the present invention, it will be understood by those skilled in the art that various changes and modifications may be made and equivalents may be substituted for elements thereof without departing from the true scope of the invention disclosed, but that the invention will include all embodiments falling within the scope of the claims

I claim:

1. A staple remover comprising:

a. a housing shaped like a handgun wherein the housing comprises a barrel section and a handle section;

b. a trigger disposed on the handle section of the housing and configured such that a user can hold the handle section of the housing and depress the trigger with a finger of the hand gripping the handle section of the housing;

c. a tumbler disposed partially in the housing, the tumbler comprising at least one tooth; and d. means for rotating the tumbler operably connected to the tumbler and operably connected to the trigger such that when the trigger is engaged the tumbler at least partially rotates, wherein the means for rotating the tumbler comprises at least one lever and one spring disposed between the trigger and the tumbler and operably connected to the trigger and the tumbler, a motor, and at least one gear.

2. A staple remover comprising:

a. a housing shaped like a handgun wherein the housing comprises a barrel section and a handle section;

b. a trigger disposed on the handle section of the housing and configured such that a user can hold the handle section of the housing and depress the trigger with a finger of the hand gripping the handle section of the housing;

c. a tumbler disposed partially in the housing, the tumbler comprising at least one tooth; and d. means for rotating the tumbler comprising a motor operably connected to the trigger, a first gear operably connected to the motor, a second gear fixedly attached to the tumbler, and a drive belt positioned around the first and second gears, wherein the motor is configured such that when the trigger is depressed, the motor is engaged and the tumbler at least partially rotates.

3. A staple remover comprising:

a. a housing shaped like a handgun wherein the housing comprises a barrel section and a handle section;

b. a trigger disposed on the handle section of the housing and configured such that a user can hold the handle section of the housing and depress the trigger with a finger of the hand gripping the handle section of the housing;

c. a tumbler disposed partially in the housing, the tumbler comprising at least one tooth; and d. means for rotating the tumbler comprising a motor disposed in the housing and operably connected to the trigger and to the tumbler and configured such that when the trigger is engaged the tumbler at least partially rotates, wherein the means for rotating the tumbler further comprises first, second, and third gears and wherein:

i. the first gear is attached to the motor for rotation in a first direction;

ii. the second gear is positioned to cooperate with the first gear such that when the first gear rotates in a first direction, the second gear rotates in a second direction; and iii. The third gear is fixedly attached to the tumbler and is positioned to cooperate with the second gear such that when the second gear rotates in a second direction, the third gear rotates in the first direction.

* * * * *